US007107949B2

(12) United States Patent
Werler et al.

(10) Patent No.: US 7,107,949 B2
(45) Date of Patent: Sep. 19, 2006

(54) DEVICE FOR VARIABLE ACTIVATION OF VALVES FOR INTERNAL COMBUSTION ENGINES

(75) Inventors: Andreas Werler, Zwickau (DE); Michael Seidel, Wilkau-Hasslau (DE); Heiko Neukirchner, Chemnitz (DE); Lutz Stiegler, Kändler (DE)

(73) Assignee: IAV GmbH Ingenieurgesellschaft Auto und Verkeh, Berlin (DE)

( * ) Notice: Subject to any disclaimer, the term of this patent is extended or adjusted under 35 U.S.C. 154(b) by 316 days.

(21) Appl. No.: 10/804,557

(22) Filed: Mar. 19, 2004

(65) Prior Publication Data

US 2006/0144355 A1 Jul. 6, 2006

Related U.S. Application Data

(63) Continuation-in-part of application No. 10/370,290, filed on Feb. 19, 2003, now Pat. No. 6,955,146.

(30) Foreign Application Priority Data

May 6, 2003 (DE) ..... 103 20 324

(51) Int. Cl.
*F01L 1/34* (2006.01)

(52) U.S. Cl. ..... 123/90.16; 123/90.2; 123/90.15; 123/90.31; 123/90.43; 251/231; 251/236; 74/519; 74/568 R; 74/569

(58) Field of Classification Search ..... 123/90.16, 123/90.2
See application file for complete search history.

(56) References Cited

U.S. PATENT DOCUMENTS 4,572,118 A 2/1986 Baguenas
5,205,247 A * 4/1993 Hoffman ..... 123/90.16
5,373,818 A * 12/1994 Unger ..... 123/90.16
6,386,162 B1 * 5/2002 Himsel ..... 123/90.16
6,907,852 B1 * 6/2005 Schleusener et al. .... 123/90.16

FOREIGN PATENT DOCUMENTS

| | | |
|---|---|---|
| DE | 2629554 | 1/1978 |
| DE | 3833540 | 4/1990 |
| DE | 19913742 | 9/2000 |
| DE | 10061618 | 6/2002 |
| DE | 10123186 | 11/2002 |

* cited by examiner

*Primary Examiner*—Thomas Denion
*Assistant Examiner*—Kyle M. Riddle
(74) *Attorney, Agent, or Firm*—Collard & Roe, P.C.

(57) ABSTRACT

A device for variable activation of valves for internal combustion engines, which is arranged in a cylinder head having a camshaft mounted in a fixed location with valves that close by means of spring force through a stroke transfer arrangement. This device includes a movable element mounted with a fixed pivot, and has a support cam and a control cam. An intermediate member is displaceably mounted and supported on the element, and is in engagement with a cam lever of the camshaft, as well as the stroke transfer arrangement. The intermediate member supports itself on the support cam and control cam with a non-positive lock, sliding during the stroke movement. Whereby the control cam determines the stroke movement to be transferred to the stroke transfer arrangement by the intermediate member, as a function of the pivot position of the element that can change its position.

8 Claims, 5 Drawing Sheets

DEVICE FOR VARIABLE ACTIVATION OF VALVES FOR INTERNAL COMBUSTION ENGINES

CROSS REFERENCE TO RELATED APPLICATIONS

Applicants claim priority under 35 U.S.C. §119 of German Application No. DE 103 20 324.9 filed May 6, 2003. This application is a continuation in part application and claims priority from U.S. patent application Ser. No. 10/370,290 filed on Feb. 19, 2003 now U.S. Pat. No. 6,955,146 wherein priority is claimed under 35 U.S.C. § 120.

BACKGROUND OF THE INVENTION

1. Field of the Invention

The invention relates to a device for variable activation of valves for internal combustion engines.

2. The Art

Devices for variable activation of valves are known in the art as shown, for example, in the document DE 100 61 618 A1. This device is arranged in a cylinder head having a camshaft mounted in a fixed location, having valves that close by means of spring force. Each of the valves has a stroke transfer arrangement associated with it. The valves are guided in a fixed location in the cylinder head. An element that is adjustable with regard to the valve stroke setting is arranged in the cylinder head, in a fixed location, and a control cam, in each instance, in an axial plane, one running after the other.

An intermediate member is prismatically supported on the element that can change positon, both on its support cam and on its control cam, with a non-positive lock. This member is guided to pivot during the stroke movement and, in this regard, to slide on the two cams.

Furthermore, the intermediate member is engaged with one of the cam levers of the camshaft, as well as with a stroke transfer arrangement for a valve. The control cam determines the movement path of the intermediate member during the stroke of the cam lever, as a function of the pivot position of the adjustable element. The control cam thereby determines the size of the stroke created by the stroke transfer arrangement at the valve.

The design configuration of this embodiment is limited, because the support cam and the control cam are arranged to run consecutively on the element that can change its position, and thereby there must be a fixed distance between the two prismatic engagement lines at the support cam and the control cam as well as at the intermediate member.

The invention relates to a device for variable activation of one or two valves activated in parallel, wherein the valves have a compact construction, and wherein interacting parts are preferably in roller engagement.

This design is achieved by creating a structure which includes a support cam or support cams arranged parallel to one another, wherein these support cams are set back radially relative to a control cam. In this case, these cams are in engagement with one slide support of an intermediate member, or one each, such that the prismatic engagement lines on the support cam and the control cam as well as the intermediate member can have a smaller distance between them. This allows an advantageous configuration of the intermediate member. At the same time, there can be an axial guidance of the intermediate member on the element that can change its position. In this case, the support cams are arranged to be axially offset relative to the control cam.

In an embodiment of the invention, a set of slide supports of an intermediate member are arranged on both sides of a control cam and of a circumference region that follows it. These supports engage with the radially set-back support cams and also engage axially with the subsequent circumference region of the control cam. Thus, there is a stable three-point support for the intermediate member on the element that can change position.

In the case of a device for a parallel activation of two valves, the control cam of the changeable element can be arranged axially between two stroke transfer arrangements for the two valves. In this case, a pressure bridge is in engagement with one of the stroke transfer arrangements, in each instance, on the intermediate member, axially next to the slide supports of the intermediate member. This type of an arrangement is particularly compact and does not require any particular construction height.

There can be a roller engagement of the slide supports arranged on the intermediate member. In this embodiment, the support cam or cams are configured as a roller mounted to rotate or pivot about a pivot axis of the changeable element.

DETAILED DESCRIPTION

Figure 1:
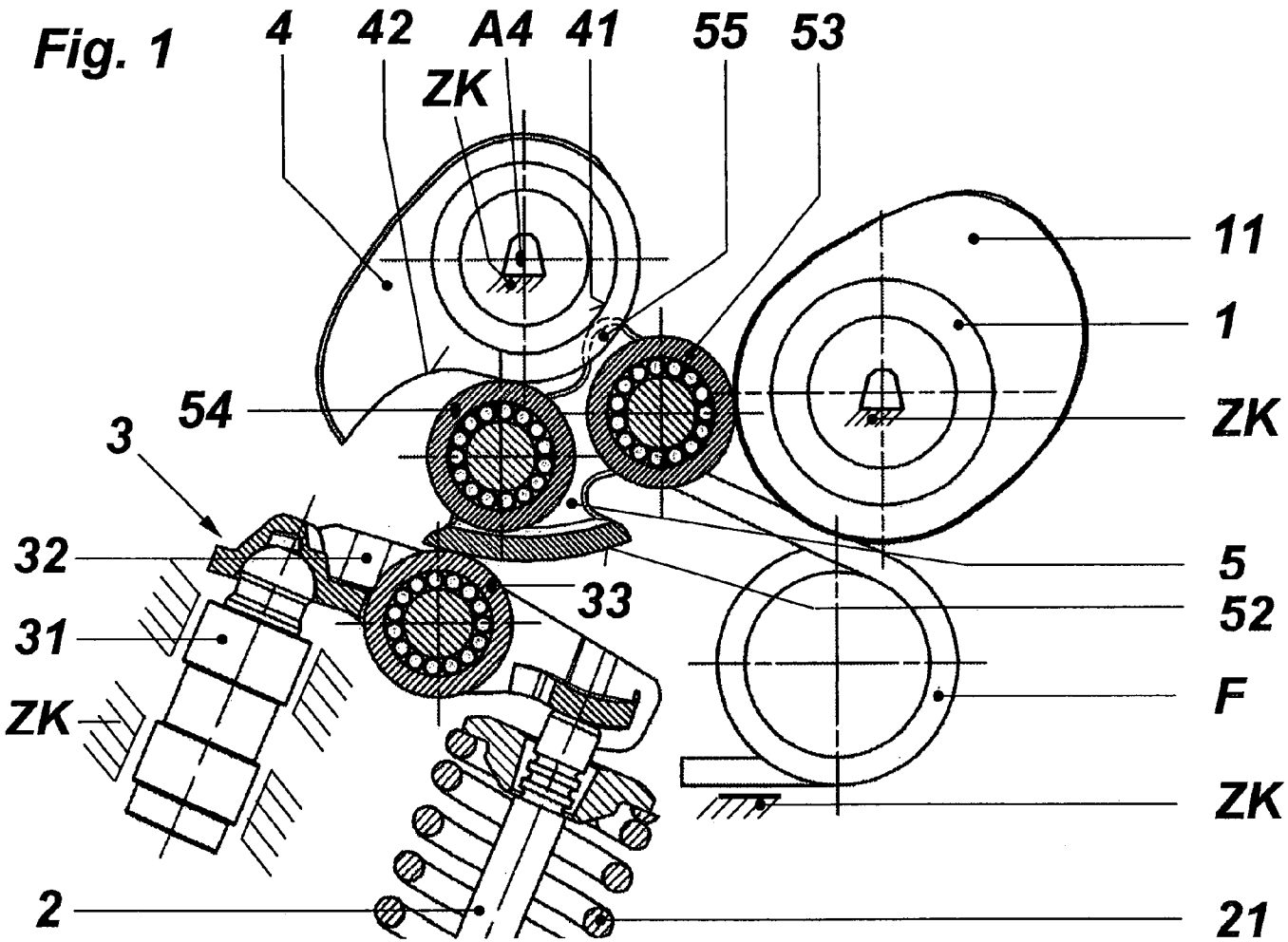
FIG. 1 is a cross-sectional view of the mechanism of an embodiment of a device according to the invention having a support cam radially back-set and axially offset relative to the control cam.

FIG. 1 shows a device for variable activation of valves, in its fundamental structure. A camshaft 1 driven by a crank shaft, if necessary by way of an angle adjustment device, is mounted to rotate in the cylinder head ZK, with a fixed axial position. This camshaft has a fixed location relative to a set of valves 2 that close by means of the force of a valve spring 21, and their assigned stroke transfer arrangements 3. These stroke transfer arrangements 3 are guided in a fixed location, which is preferably implemented as a roller lever 32 supported on a play equalization element 31.

As shown in FIG. 1, there is a movable element 4 that can change its position mounted in the cylinder head ZK, in a fixed location. Movable element 4 can pivot about a pivot axis A4 that is in a fixed position to adjust the valve stroke.

An intermediate member 5 is under the effect of the force of a spring F that can be supported on the cylinder head or elsewhere, and is in engagement with the surrounding elements that transfer the movement or support the force. On the one hand, intermediate member 5 is supported on the inside, on control cam 42, by way of a roller 54 and, on the other hand, it is supported on support cam 41 of element 4. This support cam 41 can change its position and is arranged radially set back and axially offset relative to control cam 42, by way of slide supports 55. In this way, intermediate member 5 is also in constant engagement with a cam lever 11 of camshaft 1 by way of a roller 53 mounted on it. It is also in engagement with a roller 33 of roller lever 32 of stroke transfer arrangement 3 assigned to valve 2, with its outside contour 52.

Intermediate member 5 is axially guided on control cam 42 and in a subsequent region, on both sides by way of slide supports 55. Thus, there is spatial guidance of the intermediate member 5 on the element 4 that can change position by means of the three engagement planes on the support cams 41 on both sides as well as the control cam 42 arranged between them.

With the displacement of intermediate member 5 brought about by cam lever 11, this intermediate member 5 is guided on changeable element 4 and, in this connection, depending on the position of the element 4, it is forced against roller lever 32, causing a greater or lesser stroke of valve 2.

For all of the following figures, it should be pointed out that the mounting and the method of effect of the force-transferring mechanisms are similar to the embodiment shown in FIG. 1.

Figure 2:
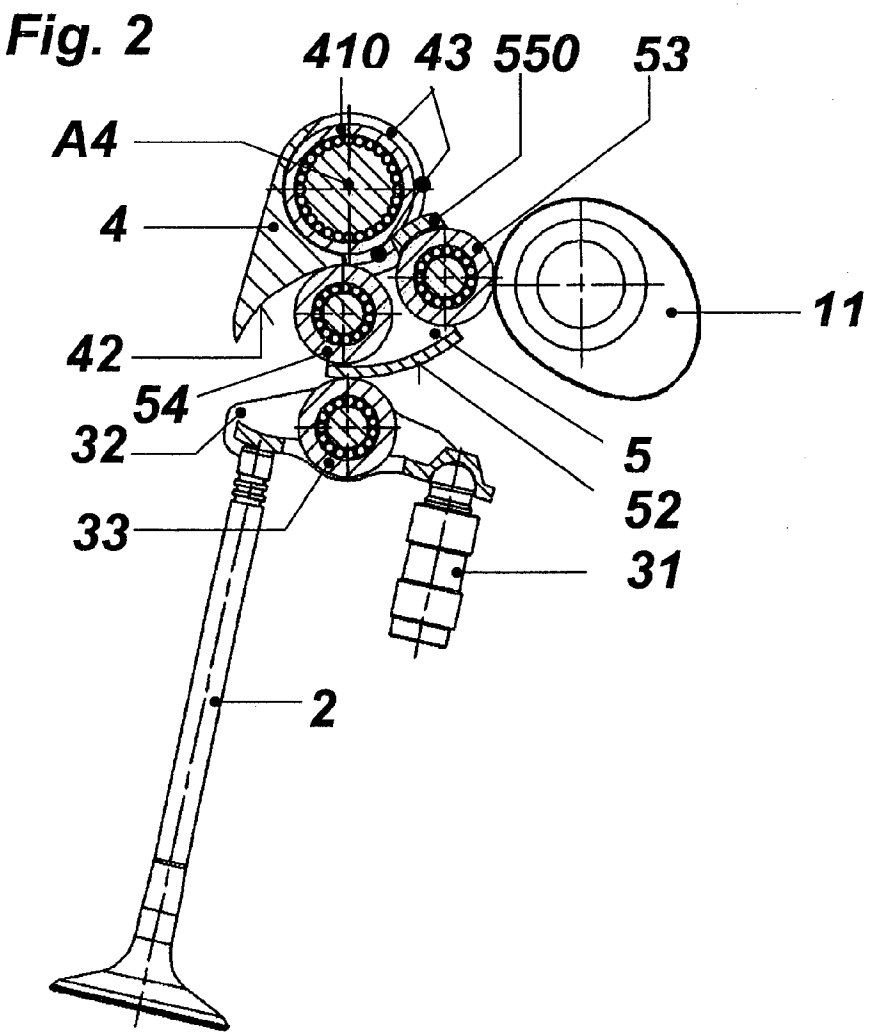
FIG. 2 is a cross-sectional view of the mechanism of an embodiment of a device according to the invention, having a support cam that is configured as a roller that can rotate.
Figure 4:
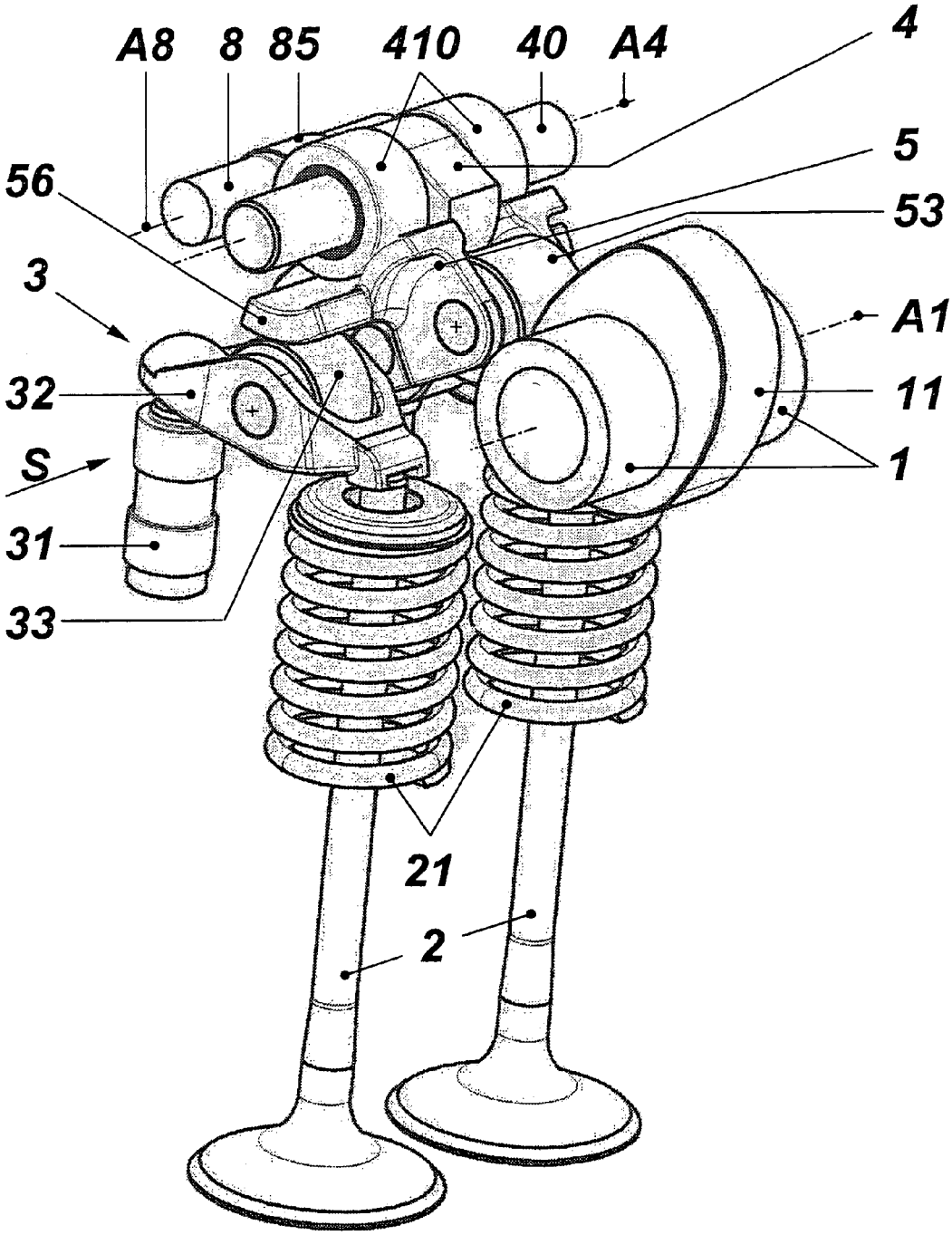
FIG. 4 is a perspective view of an embodiment of a device according to the invention, for two valves activated in parallel.
Figure 6:
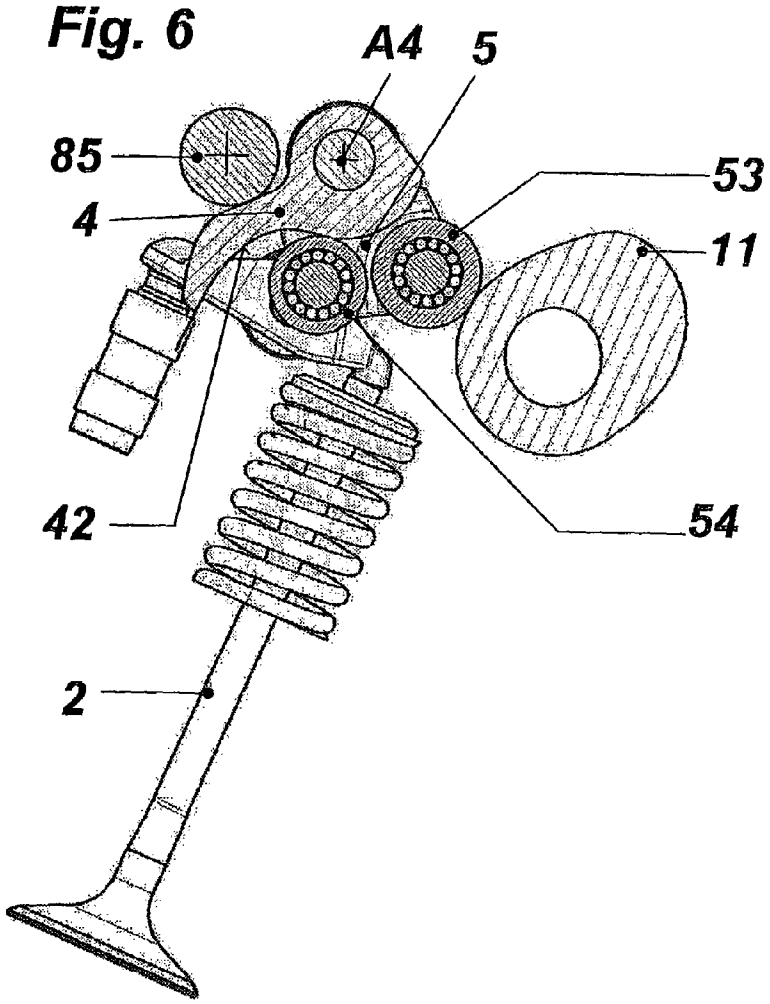
FIG. 6 is a cross-section A—A according to FIG. 8, which runs perpendicular to the cam lever axis, through the cam lever and the control cam of the adjustable element, through the device.
Figure 5:
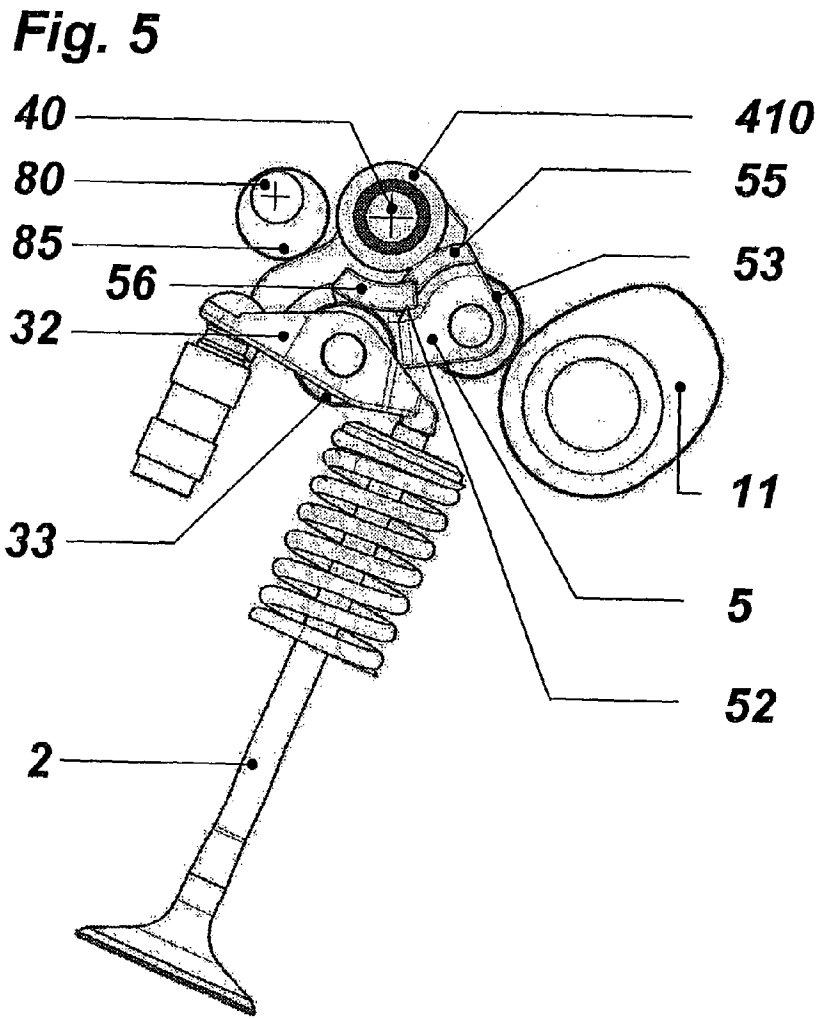
FIG. 5 is a side view taken from a view in FIG. 4 of the mechanisms according to FIG. 4.
Figure 8:
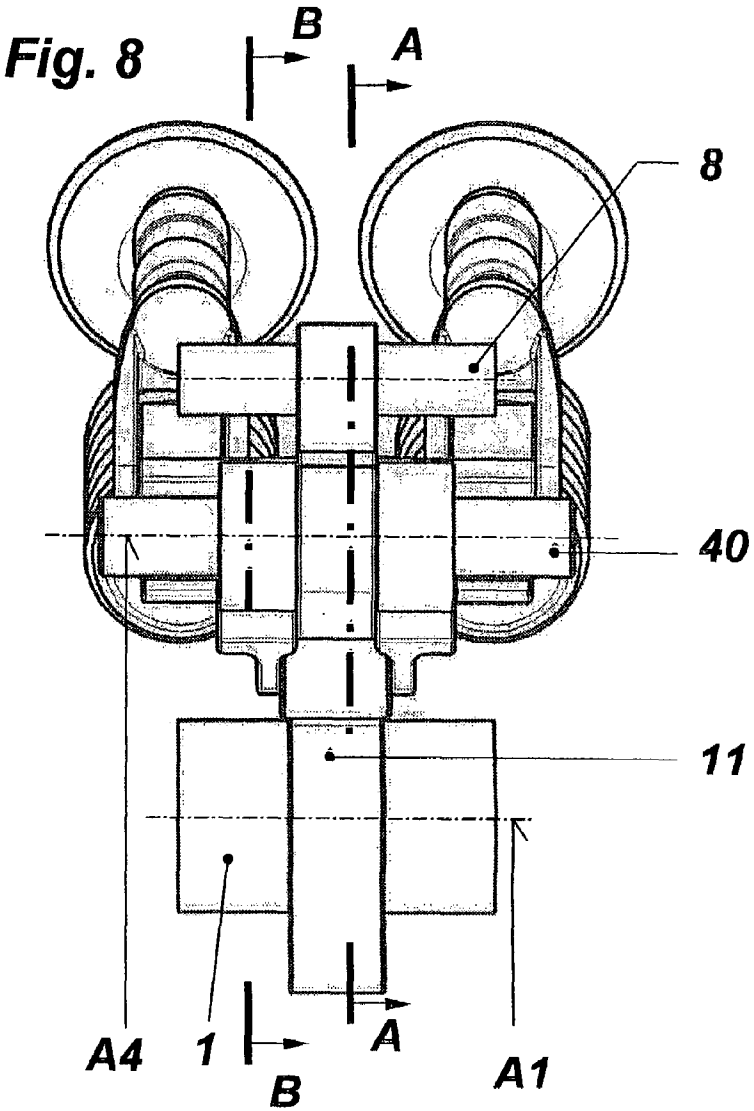
FIG. 8 is a top view of the mechanism of the device according to FIG. 1, with the sectional planes for FIGS. 6 and 7.

FIG. 2 shows a cross-sectional view of the mechanisms of a device, for activation of a valve, in schematic and simplified manner. In deviation from FIG. 1, in this embodiment, support cam 41 of element 4 is formed by the outside diameter of a roller 410 that can be rotated about pivot axis A4. A slide support 550 is adapted to partly cover roller 53 on intermediate member 5. In addition, the support of roller lever 32 on play equalization element 31 is arranged in a region below cam lever 11.

In this embodiment, slide support 550 of intermediate member 5 reaches through a slit 43 in movable or changeable element 4 and supports itself on the outside diameter of roller 410 that can rotate about the pivot axis A4. Slit 43 extends over part of the circumference of element 4, possibly even into the starting region of control cam 42. In the latter case, roller 54 slides on ridges of element 4 that run axially parallel to slit 43 and radially centered relative to axle 40, in the region of a zero stroke. (See FIGS. 2 and 3.)

With the embodiment described above, the force-transferring elements lie in an axial region, and there is a roller engagement between all of them, which can be seen from the cross-section according to FIG. 2.

Figure 3:
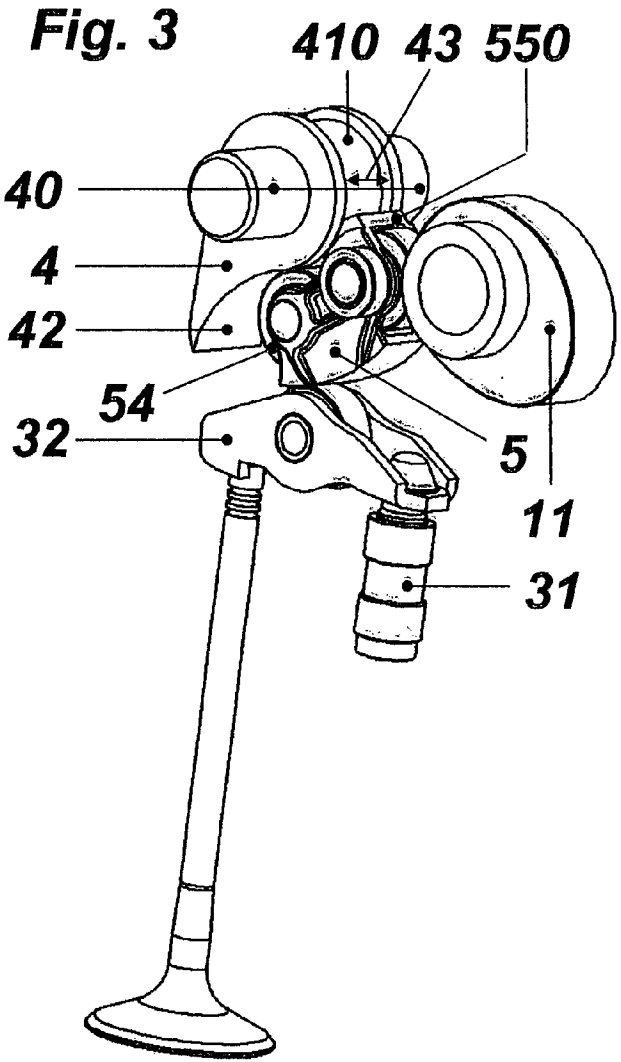
FIG. 3 is a perspective view of the device according to FIG. 2.

FIG. 3 shows a simplified perspective view of this embodiment, relating to this engagement. The axial guidance of intermediate member 5 takes place via the flanks of slide support 550 in slit 43 of changeable element 4. Roller 54 on intermediate member 5 covers the entire width of control cam 42 and thereby, if necessary, also slit 43 in the initial region, for example the zero stroke region of control cam 42. The regions of the expanse of support cam 41 and control cam 42 can overlap in the embodiments according to FIGS. 1 to 3. Thus, this design leads to a compact construction.

Different views of a device, for two valves activated in parallel, are shown in FIGS. 4 to 8. The spatially compact arrangement that is achieved, is particularly evident from FIGS. 4, 5 and 8. In this case, control cam 42 of changeable element 4 can pivot in, axially, between two stroke transfer arrangements 3 for the two valves 2 that are to be activated in parallel.

Intermediate member 5 engages with cam lever 11 by way of roller 53 mounted on it, and with control cam 42 of element 4 by way of roller 54. This is shown by way of example in FIG. 6, according to Section A—A in the top view according to FIG. 8.

Figure 7:
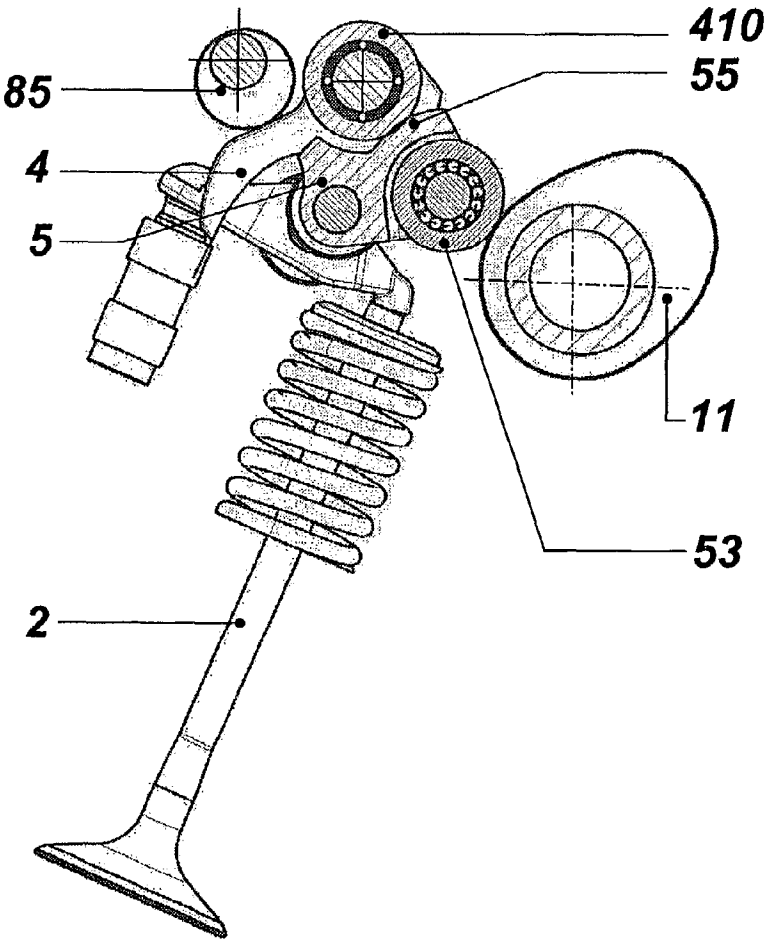
FIG. 7 is a cross-section B—B according to FIG. 8, which runs perpendicular to the cam lever axis, through the support cam of the adjustable element, which is formed by a roller.

Slide supports 55, arranged on both sides of roller 53 on intermediate member 5, engage with the outside diameter of a roller 410 that forms support cam 41, in each instance. This feature is shown in FIG. 7, which is taken according to Section B—B in FIG. 8. A pressure ridge 56 is formed axially next to slide supports 55, on intermediate member 5, in each instance. These pressure ridges 56 on both sides engage, in each instance, with their outside contour 52, with roller 33 of a stroke transfer arrangement 3. This feature is shown by way of example in FIG. 5.

Movable element 4 can pivot in its position, and can be connected with axle 40 mounted to rotate in the cylinder head, so as to rotate with it. Element 4 can be changed or held with regard to its pivot position by a stepper motor for varying the valve stroke, by way of this axle. In the embodiments according to FIGS. 2 and 3, rollers 410 are mounted to rotate freely about this axle 40.

It is also possible in the embodiment of FIGS. 4 to 8, to drive eccentric setting device 85 with a stepper motor, not shown, such that pivoting or movable element 4 changes its position to vary the valve stroke. In this case, eccentric setting device 85 forms an adjustable counter-bearing on which element 4 is constantly supported, with a non-positive lock.

Accordingly, while a few embodiments of the present invention have been shown and described, it is to be understood that many changes and modifications may be made thereunto without departing from the spirit and scope of the invention as defined in the appended claims.

REFERENCE SYMBOL LIST

1 camshaft
11 cam lever
2 valve
21 valve springs
3 stroke transfer arrangement
31 play equalization element
32 roller lever
33 roller
4 movable element, can be changed in its position, can pivot
40 axle for 4 and 41
41 support cam
410 roller, active as a support can 41, can be rotated or pivoted relative to 42
42 control cam
5 intermediate member
51 inside contour
52 outside contour
53 roller
54 roller
55 slide support
550 slide support
56 pressure ridge with outside contour 52
85 eccentric setting device
A4 pivot axis of 4
ZK cylinder head F spring, the force of which engages at 5 and rests against 4 and 11

What is claimed is:

1. A device for variable activation of valves for an internal combustion engine, which is arranged in a cylinder head (ZK) having a camshaft (1) mounted in a fixed location, having valves that close by means of a spring force, together with a stroke transfer arrangement (3) assigned to each one of the valves wherein this device is guided in a fixed location in the cylinder head, (ZK) the device comprising:

a) at least one movable element (4) for setting a valve stroke setting, wherein said movable element is disposed in the cylinder head (ZK) and pivotable around a pivot axis (A4) having a fixed position in the cylinder head, (ZK) wherein said movable element (4) has at least one support cam (41) and at least one control cam (42);

b) at least one intermediate member (5) supported on said movable element (4) which can change position, wherein said at least one intermediate member (5) can be mounted so as to be displaced;

c) at least one cam lever (11) coupled to the cam shaft (1) wherein said at least one intermediate member (5) is in engagement with said cam lever (11);

d) at least one stroke transfer element (3) which can be engaged by said cam lever (11); and e) at least one slide support (55, 550) coupled to said intermediate member (5);

wherein said at least one support cam (41) of said movable element (4) is set back radially, relative to said control cam (42) wherein said support cam (41) is in engagement with said at least one slide support (55, 550) of said intermediate member (5).

2. The device as in claim 1, wherein said at least one support cam (41) is arranged in a plane of an engagement region of said cam lever (11) and wherein the device further comprises a roller (53) coupled to said at least one intermediate member (5) and wherein said at least one slide support (55,550) is used to cover said roller in a region directed towards said at least one support cam (41).

3. The device as in claim 1, wherein said at least one support cam (41) is arranged axially offset relative to said at least one control cam (42).

4. The device as in claim 1, wherein said at least one slide support (55,550) of said at least one intermediate member (5) comprises at least two slide supports which are arranged on both sides of said at least one control cam (42) and a subsequent circumference region, wherein said at least two slide supports are in engagement with said radially set back support cam (41), and also in engagement axially with a subsequent circumference region of said at least one control cam (42).

5. The device as in claim 4, wherein said control cam (42), on said at least one movable element (4), is arranged to axially pivot in between two stroke transfer elements (3) for two valves (2), to be activated in parallel and wherein said at least one intermediate member (5) has an outside contour (52) with of said two stroke transfer arrangements (3) in each instance, wherein the device further comprises a pressure ridge (56) formed axially next to said at least one slide support (55) on said at least one intermediate member (5).

6. The device as in claim 5, further comprising a roller (410) mounted to rotate or pivot about an axle (40), wherein said at least one roller is coupled to said at least one movable element (4), forming said at least one support cam (41) that is in engagement with said at least one slide support (55) of said at least one intermediate member (5).

7. The device as in claim 6, wherein said at least one stroke transfer element (3) is adapted so that it is supported on the cylinder head (ZK) in a region below the camshaft (1).

8. The device as in claim 7, further comprising at least one eccentric setting device (85) mounted to pivot in the cylinder head, wherein said at least one eccentric setting device (85) is in engagement with said at least one movable element (4) on a back of a region forming said at least one control cam (42).

* * * * *

UNITED STATES PATENT AND TRADEMARK OFFICE

CERTIFICATE OF CORRECTION

PATENT NO. : 7,107,949 B2
APPLICATION NO. : 10/804557
DATED : September 19, 2006
INVENTOR(S) : Werler et al.

It is certified that error appears in the above-identified patent and that said Letters Patent is hereby corrected as shown below:

On the Title page, column 1, field [73], the name of the assignee should correctly read:

--IAV GmbH Ingenieurgesellschaft Auto und Verkehr--.

Signed and Sealed this

Twenty-sixth Day of December, 2006

JON W. DUDAS
*Director of the United States Patent and Trademark Office*